US008097823B2

(12) United States Patent
Bilder

(10) Patent No.: US 8,097,823 B2
(45) Date of Patent: Jan. 17, 2012

(54) WIRING STANDARD SELECTOR SWITCH AND UNIVERSAL NETWORK CABLE

(76) Inventor: Geoffrey Bilder, Ottawa (CA)

( * ) Notice: Subject to any disclaimer, the term of this patent is extended or adjusted under 35 U.S.C. 154(b) by 413 days.

(21) Appl. No.: 12/401,951

(22) Filed: Mar. 11, 2009

(65) Prior Publication Data

US 2010/0230260 A1 Sep. 16, 2010

(51) Int. Cl.
*H01H 3/42* (2006.01)

(52) U.S. Cl. ..... 200/574; 200/51.03

(58) Field of Classification Search ..... 200/51.03, 200/574; 439/52

See application file for complete search history.

(56) References Cited

U.S. PATENT DOCUMENTS

| | | | | |
|---|---|---|---|---|
| 4,579,407 | A | 4/1986 | Shimada | |
| 6,794,577 | B1 | 9/2004 | Bhogal | |
| 7,289,886 | B1 * | 10/2007 | Woytowitz | 700/284 |
| 2005/0059291 | A1 | 3/2005 | Wood | |
| 2008/0274629 | A1 | 11/2008 | Meyer | |

FOREIGN PATENT DOCUMENTS

| | | | |
|---|---|---|---|
| GB | 2213656 A | * | 8/1989 |
| GB | 2351853 A | | 10/2001 |

OTHER PUBLICATIONS

IEC L0582 T1 Cross-over Coupler publication (admitted prior art).
IEC L0585 T1 Cross-over Adapter publication (admitted prior art).
IEC L6001 Ethernet Crossover Adapter publication (admitted prior art).
Ossmann "The 5-In-1 Network Admin's Cable" publication (admitted prior art).
Canadian Office Action dated Feb. 25, 2011.

* cited by examiner

*Primary Examiner* — Elvin G Enad
*Assistant Examiner* — Lisa Klaus
(74) *Attorney, Agent, or Firm* — MacMillan, Sobanski & Todd, LLC

(57) ABSTRACT

A wiring standard selector switch for use in a universal network cable system includes a baseboard made of an insulating material and a cover shaped and dimensioned to be connected to the baseboard. A switch actuator is mounted beneath the cover and has a portion which extends through a slot formed in the cover and is movable slidably along the slot of the cover. A plurality of circuit conductors carried by the switch actuator are disposed on the switch actuator so as to achieve paired electrical contact between a first and a second set of contact members on the baseboard. By moving the switch actuator slidably along the slot of the cover, at predetermined space intervals, the first and second sets of contact members engage the plurality of circuit conductors so as to establish a different complete circuit. Each of the different complete circuits corresponds to a different network wiring standard.

17 Claims, 5 Drawing Sheets

Figure 1

| T-568A | | | |
|---|---|---|---|
| Wire Number | Wire Colour | Pair | Description |
| 1 | white/green | 3 | TxData ÷ |
| 2 | green | 3 | TxData - |
| 3 | white/orange | 2 | RxData ÷ |
| 4 | blue | 1 | unused |
| 5 | white/blue | 1 | unused |
| 6 | orange | 2 | RxData - |
| 7 | white/brown | 4 | unused |
| 8 | brown | 4 | unused |

| T-568B | | | |
|---|---|---|---|
| Wire Number | Wire Colour | Pair | Description |
| 1 | white/orange | 2 | TxData + |
| 2 | orange | 2 | TxData - |
| 3 | white/green | 3 | RxData + |
| 4 | blue | 1 | unused |
| 5 | white/blue | 1 | unused |
| 6 | green | 3 | RxData - |
| 7 | white/brown | 4 | unused |
| 8 | brown | 4 | unused |

(9)

WIRING STANDARD SELECTOR SWITCH AND UNIVERSAL NETWORK CABLE

BACKGROUND OF THE INVENTION

The present invention relates to wired computer network technologies. In particular, the present invention relates to a wiring standard selector switch capable of switching between multiple wiring standards used in wired computer networks, such as, cross-over and straight through, for example. More particularly, the present invention relates to a universal network cable comprising the wiring standard selector switch.

Wired computer networks generally consist of a plurality of network devices connected to each other using a plurality of network cables to enable data communication between each of the network devices. One of the most common forms of cabling that is used in wired networks are Category 5 (Cat5) Twisted Pair, which consists of 8 wires (4 pairs). Each of the four pairs of wires is colour coded with a primary wire (solid colour) and its counterpart secondary wire (striped), the T-568A and T-568B Cat5 network cable colouring schemes are presented in FIG. 1. To be able to connect the Cat5 network cable to network devices a male 8 Position 8 Contact (8P8C) connector or more commonly referred to as an RJ45 connector is fitted and crimped onto each end of the Cat5 network cable. Each of the primary and secondary wires at each end of the Cat5 cable is fitted into an 8P8C connector in a pre-determined order. The pre-determined wiring order are specific wiring standards and are dependant on a number of variables including, for example, the type of network device (e.g. a hub, router, network card, etc.) and whether the connection is directly connected (e.g. network card to network card) or routed through a network device (e.g. network card to network hub to network card). This is due to the fact that each of the primary and secondary wires is given a specific function which may differ between network devices, the specific function of each of the wires in the T-568A and T-568B Cat5 network cable colouring schemes are also presented in FIG. 1. Some of the more common wiring standards include, for example, crossover, straight-through, T1, ATM loopback, rolled, etc. In each of the aforementioned wiring standards it is necessary to use a specific Cat5 network cable, i.e. a cross-over cable, or a straight-through cable, to connect the network devices together.

Generally, when Network Technicians or the like are on the job they perform various tasks which may include, setting up a wired computer network, configuring network devices or troubleshooting network connectivity problems. These tasks require network connectivity between network devices and the Network Technicians' network device (in many instances this device is a notebook computer). Each of the network devices requiring the Network Technician to connect to may use a different wiring standard; thus requiring the Network Technician to have readily available a separate Cat5 network cable for each device connection. It can become expensive to purchase and cumbersome to carry all of the different types of Cat5 network cables the Network Technician might come across on the job. It would be beneficial for a Network Technician to achieve network connectivity with a variety of network devices having a variety of wiring standards using a single Cat5 network cable.

U.S. Pat. No. 6,794,577, issued Sep. 21, 2004 (Bhogal) describes cables used in computer networks and more specifically cables that incorporate multiple configuration settings. In an embodiment of the invention the network cable includes two connectors and a corresponding set of connector pins and signal wires. A coupling piece with at least two configuration settings controls the routing between the set of signal wires. The cable is transitionable between the at least two configuration settings with a hand settable switch, the position of the switch dictates the coupling configuration such as, a pass-through configuration and a crossover configuration, for example.

United States Patent Application No. 2008/0274629, published Nov. 6, 2008 (Meyer) describes an apparatus for enabling serial communication between two devices utilizing different cables, connectors or wiring schemes. An embodiment of the apparatus is composed of a rack-mountable housing with two RJ45 standard modular jacks for receiving RJ45 cables. The apparatus houses a plurality of electrical connections between the two RJ45 standard modular jacks, and the electrical connections effect a remapping of the signals between the two jacks. The remapping of the wiring may be implemented using wires connected between posts, using a printed circuit board, a programmable or processing device, or any other method for making the electrical connections between the two cable ports. The remapping of the wiring may be implemented or updated on the fly, using software or hardware switching or programming, or alternatively, hard-wired at the time of manufacture. The electronic devices may each represent a component in a computer network, including, a personal computer, a router, a gateway, a modem, a printer, a scanner, a keyboard, a mouse, or any other electronic device capable of communication using a serial communication standard.

U.S. Pat. No. 4,579,407, issued Apr. 1, 1986 (Shimada) describes an interface cable, of the RS232C standard type interface, which can perform many kinds of cable connections. A plurality of changeover switches are provided between the RS232C connectors connected at the ends of the connecting cable, which contains multiple lines therein, the switches being used for selectively changing the connection with respect to at least a part of the multiple lines. By selectively turning 'on' or 'off' each of the changeover switches various kinds of cable connections can be performed using only a single cable, such as, between modem equipment and terminal equipment, between modem equipment to modem equipment, and between terminal equipment and terminal equipment, for example.

United States Patent Application No. 2005/0059291, published Mar. 17, 2005 (Wood) describes an improved method of assembling electrical connectors to wiring, such as, for example, RJ-45 connectors. The invention provides a connector plug with an internal circuit board for rerouting the wires, and a method of attaching wires from a multi-wire cable to an RJ-45 connector plug without the requirement to manually separate, sort and route individual wires to specific pins. The wires are attached to the connector plug in the same order that they are arranged within the cable. The circuit board with the connector plug, is interposed between the pins on the connector plug, which are connected to the cable wires, and the connector pins on the other end are attached to a wall jack or a device.

The present invention was made in recognition of the above-identified art and with a view to aiding Network Technicians too easily and more efficiently enable connectivity between two network devices having different wiring standards.

SUMMARY OF THE INVENTION

It is therefore an object of the present invention to provide a universal network cable capable of easily switching between a plurality of wiring standards.

Accordingly, as an aspect of the present invention, there is provided a wiring standard selector switch for use in a universal network cable system, the switch comprising a baseboard made of insulating material, the baseboard having thereon a plurality of spaced individual contact members arranged in a first set of contact members and a second set of contact members, each contact member of the first set of contact members being adapted to receive an electrical end of an individual wire conductor of an end of an input cable and each contact member of the second set of contact members being adapted to receive an electrical end of an individual wire conductor of an end of an output cable. A cover, shaped and dimensioned to be connected to the baseboard, is disposed above and in spaced relation to the contact members of the baseboard. The cover has formed therein a slot extending longitudinally with respect to the baseboard. A switch actuating means, is mounted beneath the cover and has a portion extending through the slot formed in said cover, the switch actuating means being movable slidably along the slot of the cover. A plurality of circuit conductors carried by the switch actuating means, are disposed on the switch actuating means so as to achieve paired electrical contact between the first and second sets of contact members of the baseboard.

By moving the switch actuating means slidably along the slot of the cover, at predetermined space intervals, the first and second sets of contact members engage the plurality of circuit conductors so as to establish a different complete circuit at each of the predetermined space intervals between each of the paired electrical ends of the individual wire conductors of the input and output cables. Each of the different complete circuits corresponds to a different network wiring standard.

The individual wire conductors of the input and output cables of the present invention are preferably electrically connected to the first and second set of contact members via an input and an output RJ45 Jack, respectively and particularly preferable that the wire conductors of the input and output cables are directly electrically connected to the first and second set of contact members, respectively.

The contact members of the present invention are preferably made of an electrically conducting material, for example, but not limited to, aluminum, copper, gold, etc.

The contact members of the present invention are preferably of any type known in the art, for example, but not limited to, brush contacts, spring loaded contacts, omega contacts, unshaped contacts, etc.

The portion extending through the slot formed in the cover of the present inventions is designed preferably to be grasped by the hand.

The predetermined space intervals of the present invention are preferably defined by a series of markings on the cover and more preferably are index labels indicating the network wiring standard selected.

The plurality of circuit conductors of the present invention preferably forms a printed circuit board defining the different complete circuits of the different wiring standards.

The first and second sets of contact members of the present invention preferably contain the same number of contact members and, in a preferred embodiment, each set is linearly arranged perpendicular to the slot in the cover.

The printed circuit board of the present invention defines a series of circuit connectors arranged in a grid pattern with columns equal to the number predetermined space intervals and rows equal to the number of contact members in either the first or the second set of contact members.

The first set of contact members of the present inventions are preferably in electrical contact with only one column of the circuit connectors at each of the predetermined space intervals The second set of contact members of the present invention are preferably always in electrical contact with one column of the circuit connectors.

The number of contact members in each of the first and second sets of contact members of the present invention is preferably equal to the number of individual wires in either the input or output cable.

The baseboard and the cover of the present invention are preferably made from a hard durable plastic.

As another aspect of the present invention, there is provided a universal network cable for use in a wired computer network, the universal network cable comprising an input cable having one end operably connected to a first connector, an output cable having one end operably connected to a second connector and a wiring standard selector switch as defined herein having the first and second sets of contact members operably connected to the non-connector ends of the input and output cables, respectively.

The input and output cables of the present invention are preferably any 4 pair twisted network cables and more preferably are Category 5 or higher grade network cables.

The first and second connectors of the present invention are preferably 8 Position 8 Connector (8P8C or RJ45) connectors.

The different network wiring standards of the present invention preferably include, but are not limited to, Rolled, ATM loopback, T1, Cross-over, and Straight-through.

Various aspects of this invention will become apparent to those skilled in the art from the following detailed description of the preferred embodiment, when read in light of the accompanying drawings.

BRIEF DESCRIPTION OF THE DRAWINGS

Embodiments of the present invention will be further described, by way of example, with reference to the accompanying drawings, in which:

FIG. 1 depicts a wiring colour scheme of a typical four pair twisted network cable;

DETAILED DESCRIPTION OF THE PREFERRED EMBODIMENT

Standard network cables that are used in wired computer networks are compatible with only one type of wiring standard, such as, straight through or cross-over, for example. Network technicians, or the like, who need network connectivity with various network devices may, on any given day, encounter a number of different wiring standards, and as a result, must be equipped with a different type of network cable for each of the wiring standards. The present invention overcomes this difficulty by providing a universal network cable capable of switching between a plurality of wiring standards, thus enabling a Network technician, or the like, to be equipped with only a single network cable.

Figure 2:
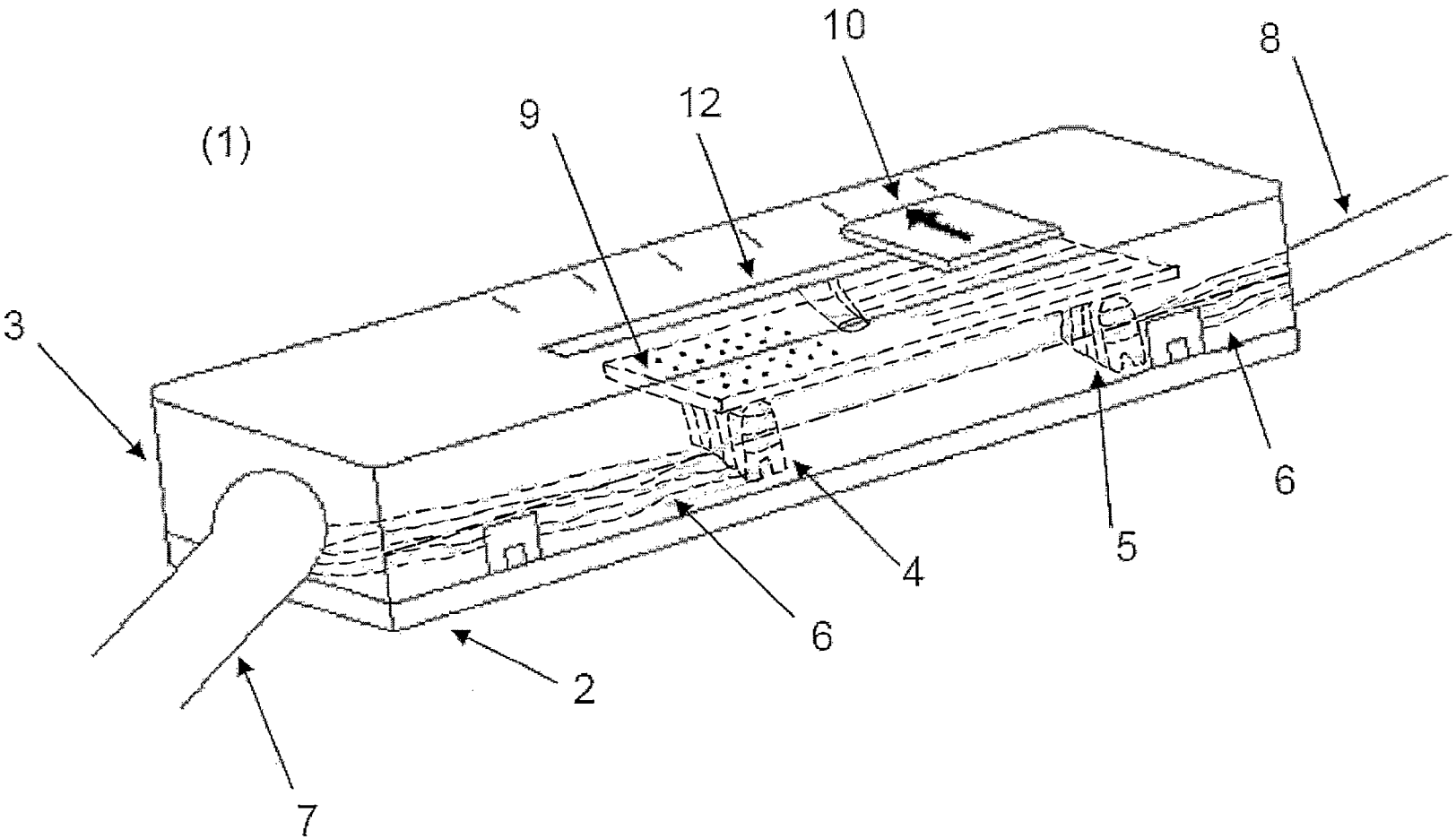
FIG. 2 is a 3-dimensional perspective view of the wiring standard selector switch of an embodiment of the present invention.

FIG. 2 is a 3-dimensional perspective view of the wiring standard selector switch of an embodiment of the present invention. The wiring standard selector switch (1) may consist of a baseboard (2) and a cover (3) which fit and snaps together forming an enclosed boxed switch. However, any housing adapted to the purpose of the invention herein may be used as known to a person skilled in the art. Affixed to the inside of the baseboard (2) of the wiring standard selector switch (1) are a plurality of individual contact members arranged in a first set of contact members (4) and a second set of contact members (5). The first set of contact members (4) and the second set of contact members (5) are each electrically connected to the electrical end of the individual wire conductors (6) from an input cable (7) and an output cable (8) and are rigidly fixed in place. The wiring standard selector switch (1) incorporates a printed circuit board (9) and a portion shaped to be grasped by the hand (10), which may be, but not limited to, a handle. The printed circuit board has defined thereon various network wiring standards which create an electrical signal path between each of the first set of contact members (4) and the second set of contact members (5). The printed circuit board (9) is rigidly affixed to the portion to be grasped by the hand (10) in such a manner that allows the printed circuit board (9) to be in electrical contact with the first set of contact members (4) and the second set of contact members (5) creating a direct transmission line for each of the electrical end of the individual wire conductors (6) from the connector end of the input cable (7) to the connector end of the output cable (8).

Figure 3:
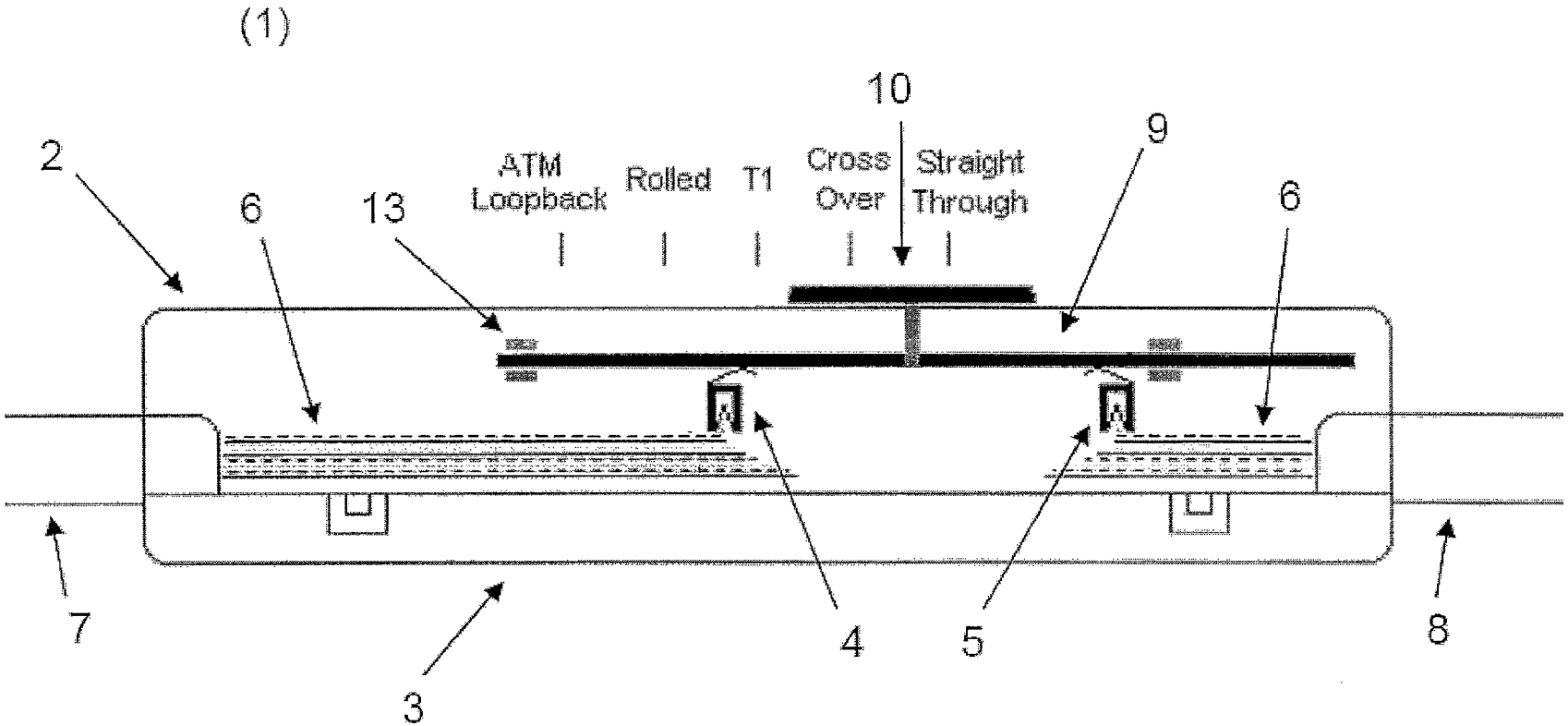
FIG. 3 is a perspective side view of an embodiment of the wiring standard selector switch of the present invention.

FIG. 3 is a perspective side view showing the electrical signal path of an embodiment of the present invention. The electrical end of the individual wire conductors (6) of input cable (7) are electrically connected to the first set of contact members (4) which are in electrical contact with the printed circuit board (9). The printed circuit board (9) is also in electrical contact with the second set of contact members (5) which are electrically connected to the electrical end of the individual wire conductors (6) of output cable (8), thus creating the electrical signal path for each of the electrical end of the individual wire conductors between the input cable (7) and the output cable (8) through printed circuit board (9) which defines different network wiring standards.

Figure 4:
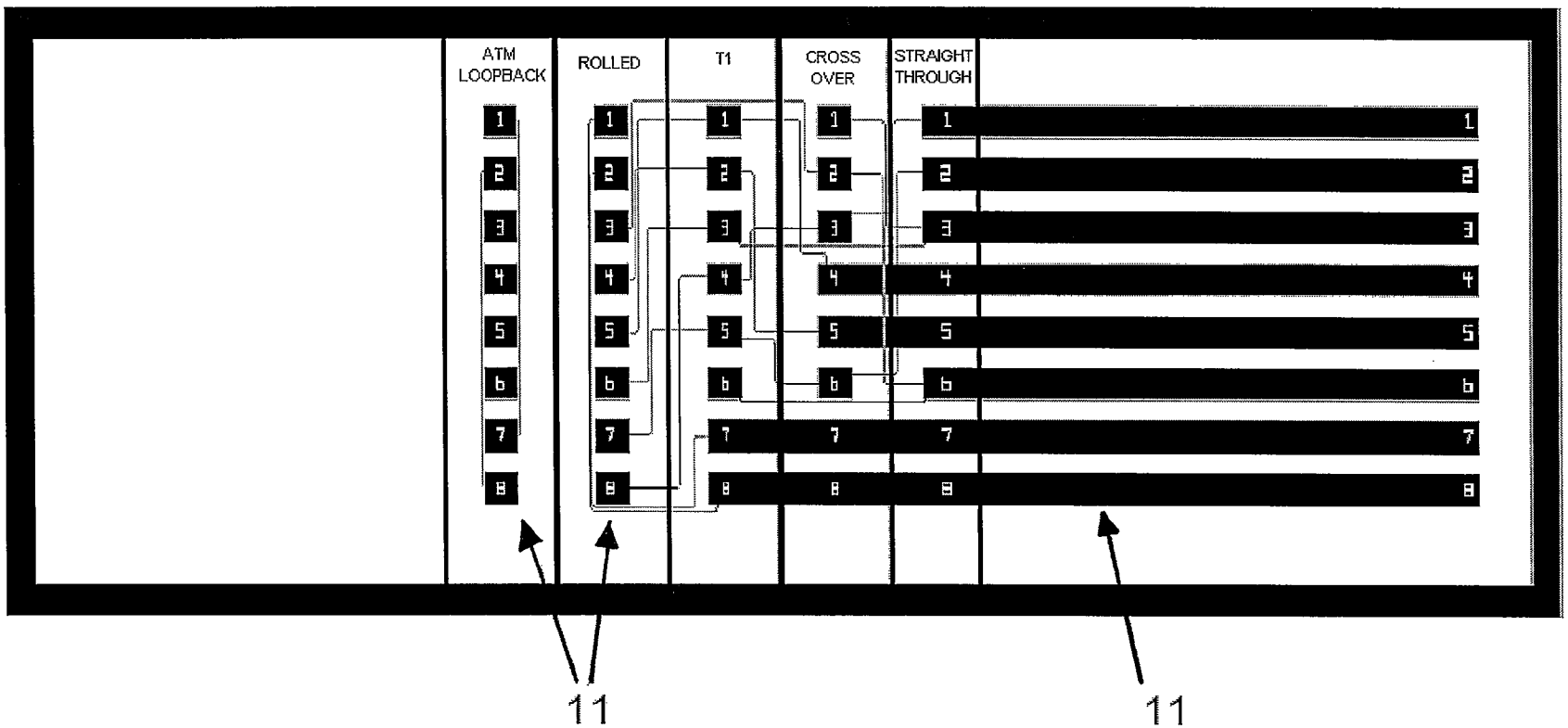
FIG. 4 is a perspective top view of an embodiment of the printed circuit board.

FIG. 4 is a perspective view of an embodiment of the printed circuit board (9). The printed circuit conductors (11) on the output side (right side of FIGS. 3 and 4) of the printed circuit board (9) are positioned and aligned in such a way that at any given time the second set of contact members (5) are always in electrical contact with each other. The printed circuit conductors (11) on the input side (left side of FIGS. 3 and 4) of the printed circuit board (9) are positioned and aligned such that at any given time only the desired column (wiring standard selection) of printed circuit conductors (11) are in electrical contact with the first set of contact members (4). This allows the wiring standard selector switch (1) to be manually set between network wiring standards without fear of having improper or loose electrical connections.

Figure 5:
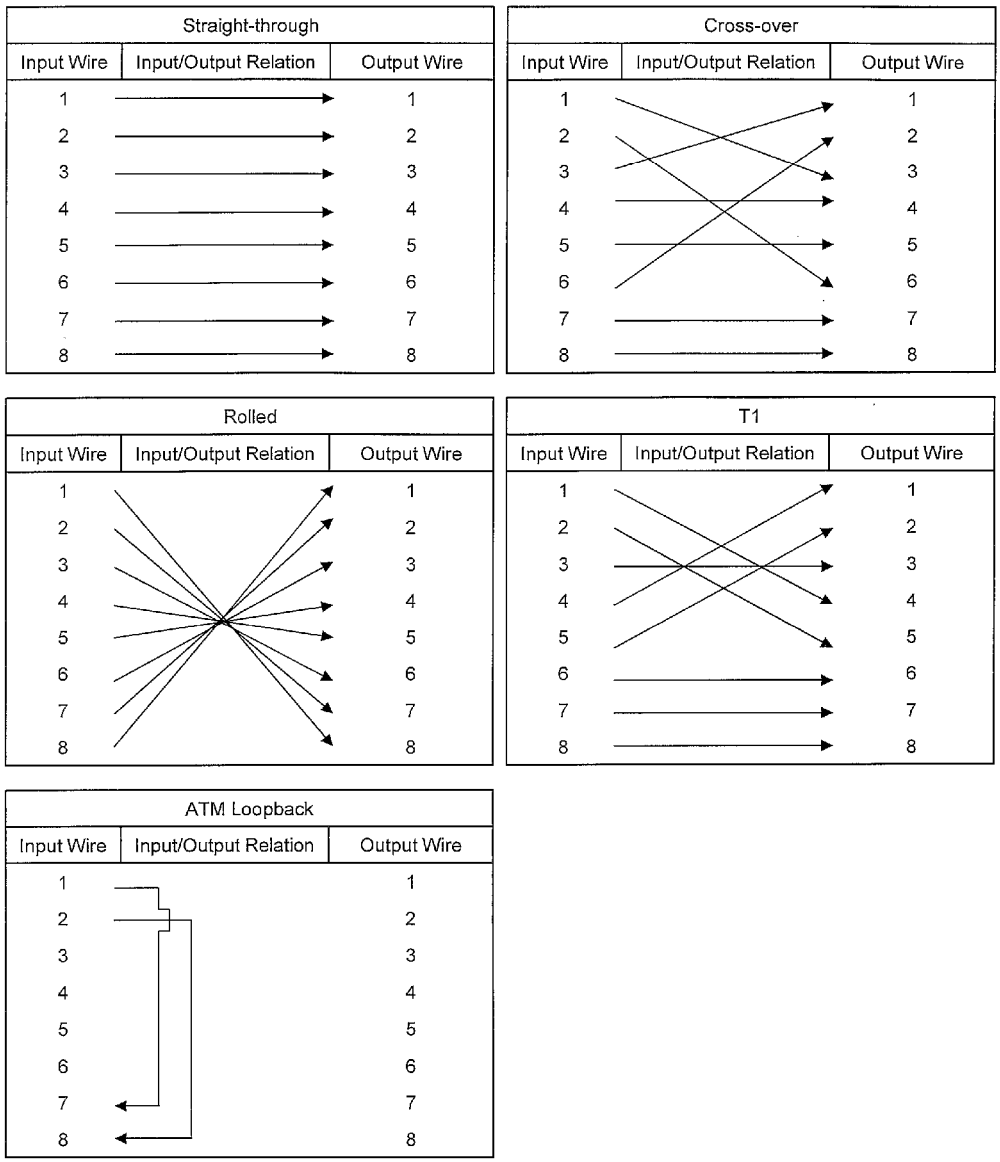
FIG. 5 is a set of tables showing the input/output relations of individual wires in a typical four pair twisted network cable of five common wiring standards.

FIG. 5 presents a set of tables that correspond to different wiring standards. For each wiring standard, the table defines the paired electrical connection between each of the first set of contact members (4) and the second set of contact members (5).

The cover (3) of the wiring standard selector switch (1) incorporates a slot (12) to enable manual movement of the portion to be grasped by the hand (10) into any one of the desired wiring standards. Once a wiring standard is chosen the switch is locked into place, creating a secure electrical circuit without fear of losing connection.

To allow the switch actuating means to move slidably along the slot of the cover (3) any means known in the art may be used, preferably there is provided at least two pairs of protruding members (13) on the inside of the cover (3). The protruding members (13) are positioned with at least one pair on each longitudinal side, such that the switch actuating means is guided by the at least two pairs of protruding members (13) allowing for one-dimensional movement along the direction of the slot (2).

To provide customizability, the wiring standard selector switch (1) may be provided without input cable (7) and output cable (8), allowing a Network Technician, or the like, to arbitrarily define their own length of network cable to be used with the wiring standard selector switch (1), to create a universal network cable. Additionally, to provide even more customizability, the wiring standard selector switch (1) may be provided with an input and an output RJ45 Jack electrically connected to the first set of contact members (4) and the second set of contact members (5), respectively, allowing the Network Technician, or the like, to selectively use pre-made straight-through network cables to create a universal network cable.

Network cables are commonly known in the art, and are not specific to the invention. Thus it will be known to one skilled in the art how to integrate such a device with the universal network cable described herein.

Printed circuits boards are commonly known in the art, and are not specific to the invention. Thus, it will be known to one skilled in the art how to design and integrate such a device together with the universal network cable wiring standard selector switch (1) described herein.

The foregoing are exemplary embodiments of the present invention and a person skilled in the art would appreciate that modifications to these embodiments may be made without departing from the scope and spirit of the invention.

What is claimed is:

1. A wiring standard selector switch comprising:

(i) a baseboard made of insulating material, the baseboard having thereon a plurality of spaced individual contact members arranged in a first set of contact members and a second set of contacts members, each contact member of the first set of contact members being adapted to receive an electrical end of an individual wire conductor of an end of an input cable and each contact member of the second set of contact members being adapted to receive an electrical end of an individual wire of an end of an output cable;

(ii) a cover shaped and dimensioned to be connected to the baseboard, the cover being disposed above and in spaced relation to the contact members of the baseboard, the cover having formed therein a slot extending longitudinally with respect to the baseboard, (iii) a switch actuating means, the switch actuating means being mounted beneath the cover and having a portion extending through the slot formed in said cover, the switch actuating means being movable slidably along the slot of the cover; and (iv) a plurality of circuit conductors carried by the switch actuating means, the plurality of circuit conductors being disposed on the switch actuating means so as to achieve paired electrical contact between the first and second sets of contact members of the baseboard;

whereby moving the switch actuating means slidably along the slot of the cover, at predetermined space intervals, the first and second sets of contact members engage the plurality of circuit conductors so as to establish a different complete circuit at each of the predetermined space intervals between each of the paired electrical ends of the individual wire conductors of the input and output cables, wherein each of the different complete circuits correspond to a different network wiring standard.

2. The wiring standard selector switch according to claim 1, wherein the individual wire conductors of the input and output cables are electrically connected to the first and second set of contact members via an input and an output RJ45 Jack, respectively.

3. The wiring standard selector switch according to claim 1, wherein the individual wire conductors of the input and output cables are directly electrically connected to the first and second set of contact members, respectively.

4. The wiring standard selector switch according to claim 1, wherein the contact members are electrical brush contacts.

5. The wiring standard selector switch according to claim 1, wherein the contact members are spring loaded electrical contacts.

6. The wiring standard selector switch according to claim 1, wherein the portion extending through the slot formed in the cover is a handle.

7. The wiring standard selector switch according to claim 1, wherein the predetermined space intervals are defined by a series of markings on the cover.

8. The wiring standard selector switch according to claim 7, wherein the series of markings are index labels indicating the network wiring standard selected.

9. The wiring standard selector switch according to claim 1, wherein the plurality of circuit conductors form a printed circuit board; and wherein the printed circuit board defines the different complete circuits.

10. The wiring standard selector switch according to claim 9, wherein the first and second sets of contact members each contain the same number of contact members and each set is linearly arranged perpendicular to the slot in the cover;

wherein the printed circuit board defines a series of circuit connectors arranged in a grid pattern with columns equal to the number predetermined space intervals and rows equal to the number of contact members in either the first or the second set of contact members;

wherein the first set of contact members are in electrical contact with only one column of the circuit connectors at each of the predetermined space intervals; and wherein the second set of contact members are always in electrical contact with one column of the circuit connectors.

11. The wiring standard selector switch according to claim 1, wherein the number of contact members in each of the first and second sets of contact members is equal to the number of individual wires in either the input or output cable.

12. The wiring standard selector switch according to claim 1, wherein the baseboard and the cover are made from a hard durable plastic.

13. A universal network cable system comprising:

(i) an input cable having one end operably connected to a first connector;

(ii) an output cable having one end operably connected to a second connector; and (iii) a wiring standard selector switch as defined in claim 1 having the first and second sets of contact members operably connected to the non-connector ends of the input and output cables, respectively.

14. The universal network cable according to claim 13, wherein the input and output cables are any four pair twisted network cables.

15. The universal network cable according to claim 13, wherein the input and output cables are Category 5 or higher grade network cables.

16. The universal network cable according to claim 13, wherein the first and second connectors are 8 Position 8 Connector (8P8C or RJ45) connectors.

17. The universal network cable according to claim 13, wherein the different network wiring standards include: Rolled, ATM loopback, T1, Cross-over, or Straight-through.

* * * * *